US006554135B1

(12) United States Patent
Luceri et al.

(10) Patent No.: US 6,554,135 B1
(45) Date of Patent: Apr. 29, 2003

(54) SHELF READY INNER PACKAGE SHIPPING CONTAINER

(75) Inventors: Thomas L. Luceri, Neshanic Station, NJ (US); Jeffery S. Majetich, Neenah, WI (US)

(73) Assignee: Johnson & Johnson Consumer Companies, Inc., Skillman, NJ (US)

( * ) Notice: Subject to any disclaimer, the term of this patent is extended or adjusted under 35 U.S.C. 154(b) by 0 days.

(21) Appl. No.: 09/663,506

(22) Filed: Sep. 15, 2000

Related U.S. Application Data

(60) Provisional application No. 60/176,896, filed on Jan. 19, 2000, and provisional application No. 60/157,369, filed on Oct. 1, 1999.

(51) Int. Cl.[7] ..... B65D 85/00

(52) U.S. Cl. ..... 206/526; 206/745; 206/774; 206/736; 229/242; 229/235

(58) Field of Search ..... 206/525, 526, 206/745, 746, 461, 467, 470, 485, 561, 736, 738, 774, 806, 767, 45.28, 45.29, 45.3, 769; 229/235–240, 164, 242; 211/72

(56) References Cited

U.S. PATENT DOCUMENTS

| | | | | | |
|---|---|---|---|---|---|
| 2,922,552 | A | * | 1/1960 | Berger et al. | 222/185.1 |
| 4,553,666 | A | | 11/1985 | Gullikson | 206/44 R |
| 5,020,719 | A | * | 6/1991 | Roth et al. | 229/122.1 |
| 5,167,324 | A | * | 12/1992 | Miller | 206/44.12 |
| 5,181,650 | A | * | 1/1993 | Hollander et al. | 229/103 |
| 5,464,151 | A | | 11/1995 | Parker et al. | 229/206 |
| 5,582,345 | A | * | 12/1996 | Lankhuijzen | 229/235 |
| 5,690,213 | A | * | 11/1997 | Matsumura | 206/45.21 |
| 5,803,348 | A | | 9/1998 | Verhelle | 229/125.08 |
| 5,881,884 | A | * | 3/1999 | Podosek | 206/774 |
| 6,062,424 | A | * | 5/2000 | Simile-Gravina et al. | 221/305 |
| 6,158,579 | A | * | 12/2000 | Rosenbaum | 206/45.29 |

FOREIGN PATENT DOCUMENTS

| | | |
|---|---|---|
| GB | 2 162 820 | 2/1986 |
| GB | 2 233 316 | 1/1991 |
| GB | 2 278 341 | 11/1994 |

* cited by examiner

*Primary Examiner*—Mickey Yu
*Assistant Examiner*—Jila M. Mohandesi
(74) *Attorney, Agent, or Firm*—Michele G. Mangini

(57) ABSTRACT

The present invention relates to an inner container configured for shipping, storing, and displaying products. The container comprises upper and lower portions linked by a discontinuous line of weakness, wherein the upper portions collectively form a container top section that can be easily and cleanly removed and disposed of, while the lower portions collectively form a container bottom section that is retained for displaying contained products.

17 Claims, 7 Drawing Sheets

SHELF READY INNER PACKAGE SHIPPING CONTAINER

CROSS-REFERENCE TO RELATED APPLICATION

This Application claims the benefit of U.S. Application No. 60/157,369 filed on Oct. 1, 1999 and U.S. Application No. 60/176,896 filed on Jan. 19, 2000, which are both incorporated by reference in their entireties herein.

FIELD OF THE INVENTION

The present invention relates to an inner container useful for shipping products. The inner container provides satisfactory protection during transportation and storage, and is easily and efficiently manipulated to display contained products for sale.

BACKGROUND OF THE INVENTION

Many products are shipped as multiple units of the product in one large container, with the intention of breaking them into smaller units. This can be done to minimize the shelf space for the product while maintaining back stock, or for a company to send separate units to different branch stores. To make this process user friendly, companies have developed inner containers, which can easily be removed from the large container. Most commonly, the inner containers are boxes which each hold several units of the product. The inner containers are placed in a larger shipping container and shipped to buyers.

The products ultimately are displayed on store shelves. The storage of products on store shelves can be problematic. Products are typically placed onto the shelves by hand in a very orderly manner, but consumer interaction can create an unstable presentation of the products and inconsistent shelf appearance. The products can be knocked onto the floor or other unwanted areas, tipped over into a position that inadequately portrays the products to the consumer, and potentially damaged, resulting in a loss of profit for the companies manufacturing and selling the products. Adjacent products can also become intermixed, creating confusion for the consumer.

In an effort to improve the above deficiencies of stocking and selling products, numerous containers have been designed and configured to act as display trays. The containers, housing a plurality of articles, can be placed onto a shelf in one step and minimize article displacement and/or damage. Examples of such containers are illustrated in the following: UK Patent Application Nos. 2,278,341 A and 2,233,316 A and U.S. Pat. Nos. 4,553,666 and 5,464,151. Disadvantages with these containers, and others not listed, include difficult and aesthetically unacceptable opening, inadequate protection during transportation, and unsatisfactory article portrayal and retention.

U.S. Pat. No. 5,803,348 attempts to address these disadvantages. The '348 patent discloses a container that can be converted into a display by removing a hood portion from a tray portion with one hand. When the hood portion is removed, an associated front wall of the tray portion is also totally removed, allowing an unobstructed view of, and access to, the housed articles. Two disadvantages are apparent from this design. First, by totally removing the front wall, articles are not protected from being knocked to the floor or other unwanted areas. Second, the process of removing the hood and front wall frequently results in tearing the remainder of the container. When this occurs, the torn container is not aesthetically appealing for marketing purposes.

UK Patent Application No. 2,162,820 A discloses a container having cut-away side walls on both a front and back region. A disadvantage of this design is that articles can fall out of the back of the container when opening and displaying. The container requires tearing four walls in order to display the products within the container.

Thus, there is a need for an inner container that provides adequate protection during transportation and storage, yet is easily and cleanly opened for orderly display and retention of the products contained in it.

SUMMARY OF THE INVENTION

The present invention provides an inner container configured for shipping, storing, and/or displaying goods, including: a bottom wall, two side walls, a front wall, and a back wall; the inner container further comprising a top section and a bottom section;

the top section comprised of an upper front wall, two upper side walls, and optionally an upper back wall;

the bottom section comprised of a lower front wall, two lower side walls, a back wall, and the bottom wall;

the container top and bottom sections being linked by a discontinuous line of weakness having portions positioned substantially diagonally on the two side walls; wherein removal of the container top section from the container bottom section provides a display unit having side walls that increase in height from the front wall of the display unit to the back wall of the display unit.

Opening of the container can conveniently begin from any side with the same end result. Additionally, the discontinuous line of weakness employs design features to provide consistent, easy, and clean opening to maintain operability and pleasing aesthetics during display.

On removal of the container top section, the inner container of the present invention provides a display unit, which permits a sufficient balance between retaining the products in the display unit without displacement or damage and allowing for easy access by the consumer. Further, the inner container of the present invention employs materials and design features that provide satisfactory protection during transportation.

DETAILED DESCRIPTION OF THE INVENTION

The inner container of the present invention comprises a discontinuous line of weakness separating the container top section and the container bottom section. The discontinuous line of weakness is "discontinuous" in that it does not run along the entire perimeter of the inner container. In other words, the container top section and the container bottom section are not fully contiguous. Where they do touch, they are separated by the line of weakness.

Figure 6:
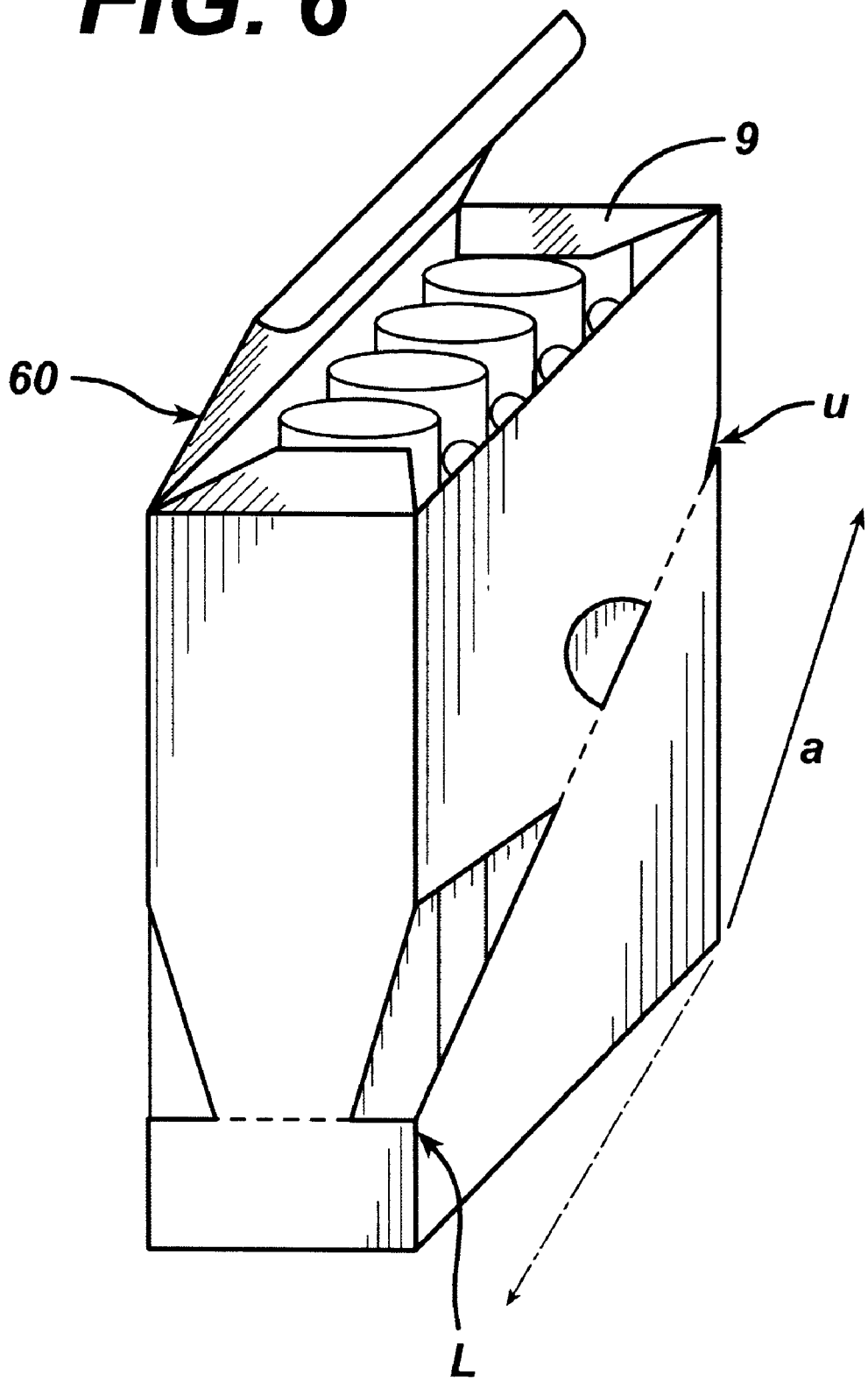
FIG. 6 is a perspective view of an inner container according to the invention with the back wall having an upper portion and the inner container having a top tuck wall.

Portions of the line of weakness run substantially diagonally along each side wall of the inner container. These portions, however, do not stretch entirely across the side walls. As shown in FIG. 6, each side wall 2 and 3 has a side wall length, "a" extending from a lower end (identified as "L") and an upper end (identified as "U"). The line of weakness is included along the side wall length.

On each side wall, the line of weakness is from about 35 percent to about 90 percent, more preferably from about 40 percent to about 85 percent, of the side wall length along the diagonal discontinuous line of weakness.

The line of weakness can be made using any known mechanical means, such as scoring or perforating; chemical means, such as chemical etching; physical means, such as a laser; or combinations thereof. Each portion of the line of weakness can be a single line, or alternatively a series of lines, such as those that make up a tear strip configuration. Preferably, the line of weakness is a perforated line as illustrated in FIG. 1.

In one embodiment of the present invention, the discontinuous line of weakness is characterized by one or more adjacent cutouts, so that a shape selected from a circle, a semi-circle, an oval, a rectangle, a triangle, and a diamond is formed approximately midway along a portion of the line of weakness. The length and height of an adjacent cutout are not critical, but preferably provide access for at least one finger to be inserted, providing an area to grab for aiding in tearing away the upper portion of the side walls. In general, the length of an adjacent cutout may range from about 20 percent to about 35 percent, preferably from about 25 percent to about 30 percent, of the total length of the line of weakness it boarders. The height of an adjacent cutout may range from about 5 percent to about 30 percent, preferably from about 10 percent to about 20 percent, of the distance between the lowest point (i.e., nearest the bottom wall) of the adjacent cutout to the top of the upper portion of the side wall on which it is located.

Figure 1:
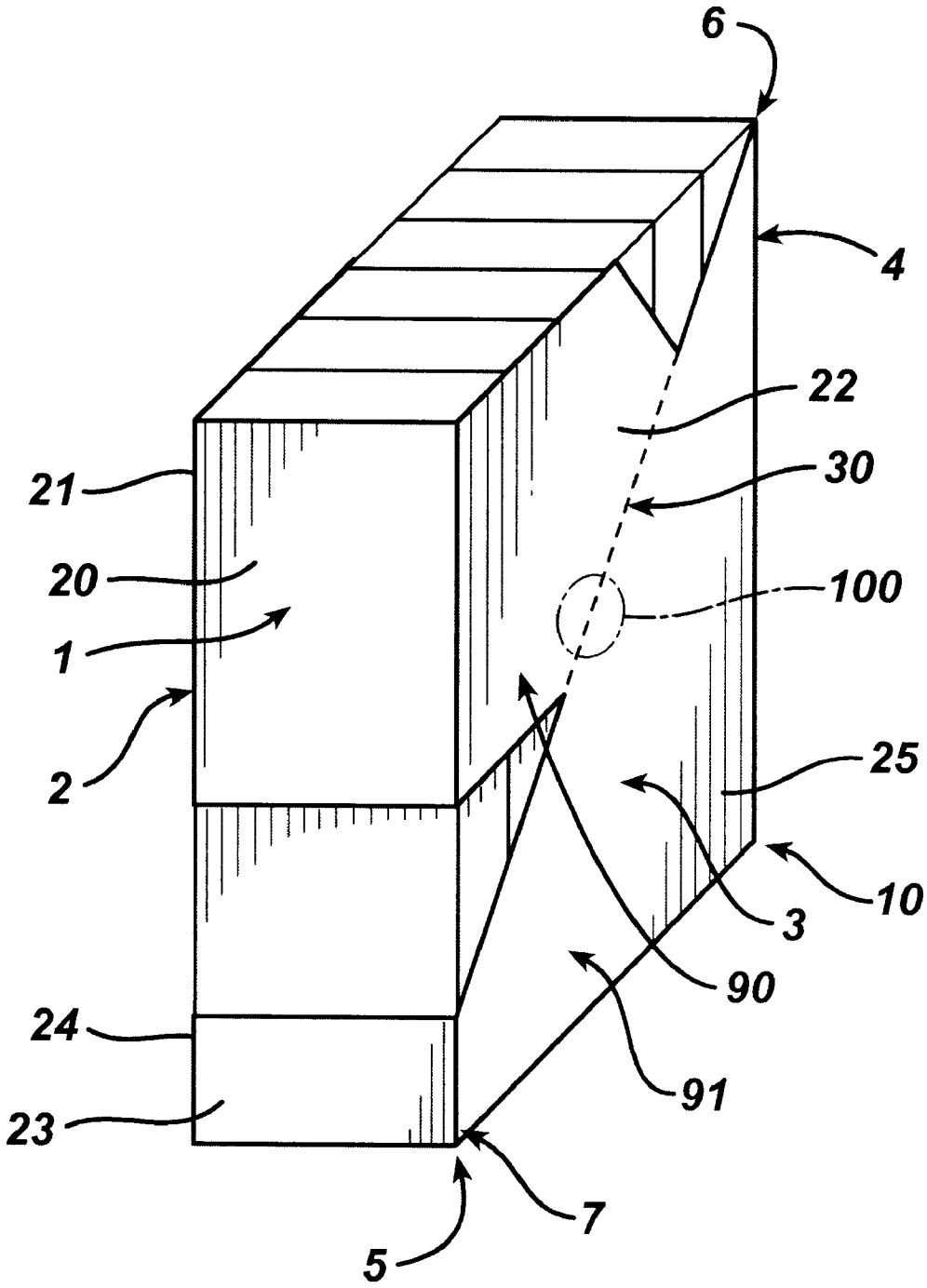
FIG. 1 is a perspective view of an inner container according to the present invention with both container top and bottom sections depicted, showing the discontinuous line of weakness.

In one embodiment of the present invention, the upper portion of the front wall of the inner container is not connected to the lower portion of the front wall of the inner container, as illustrated in FIG. 1. In this embodiment, the distance between the lower portion of the front wall and the upper portion of the front wall may range from about 5 percent to about 80 percent, preferably from about 20 percent to about 40 percent, of the total height of the front wall as measured from the bottom of the lower portion of the front wall to the top of the upper portion of the front wall.

Figure 3:
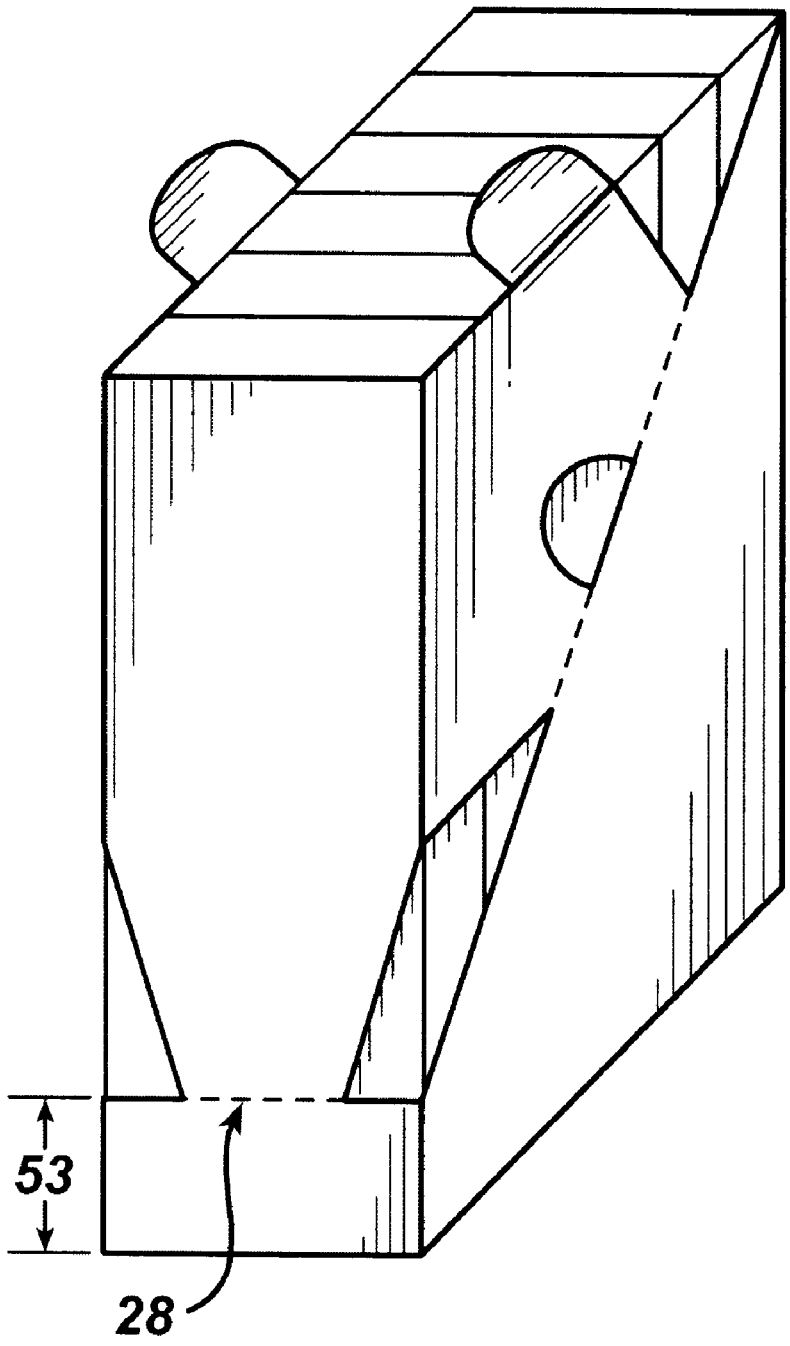
FIG. 3 is a perspective view of an inner container according to the present invention with both container top and bottom sections depicted, and a portion of the discontinuous line of weakness connecting the upper and lower portions of the front wall.

In a preferred embodiment of the present invention, the upper portion of the front wall is connected to the lower portion of the front wall, as illustrated in FIG. 3. In this embodiment, the upper portion of the front wall is connected to the lower portion of the front wall by a further portion of the discontinuous line of weakness.

Figure 2:
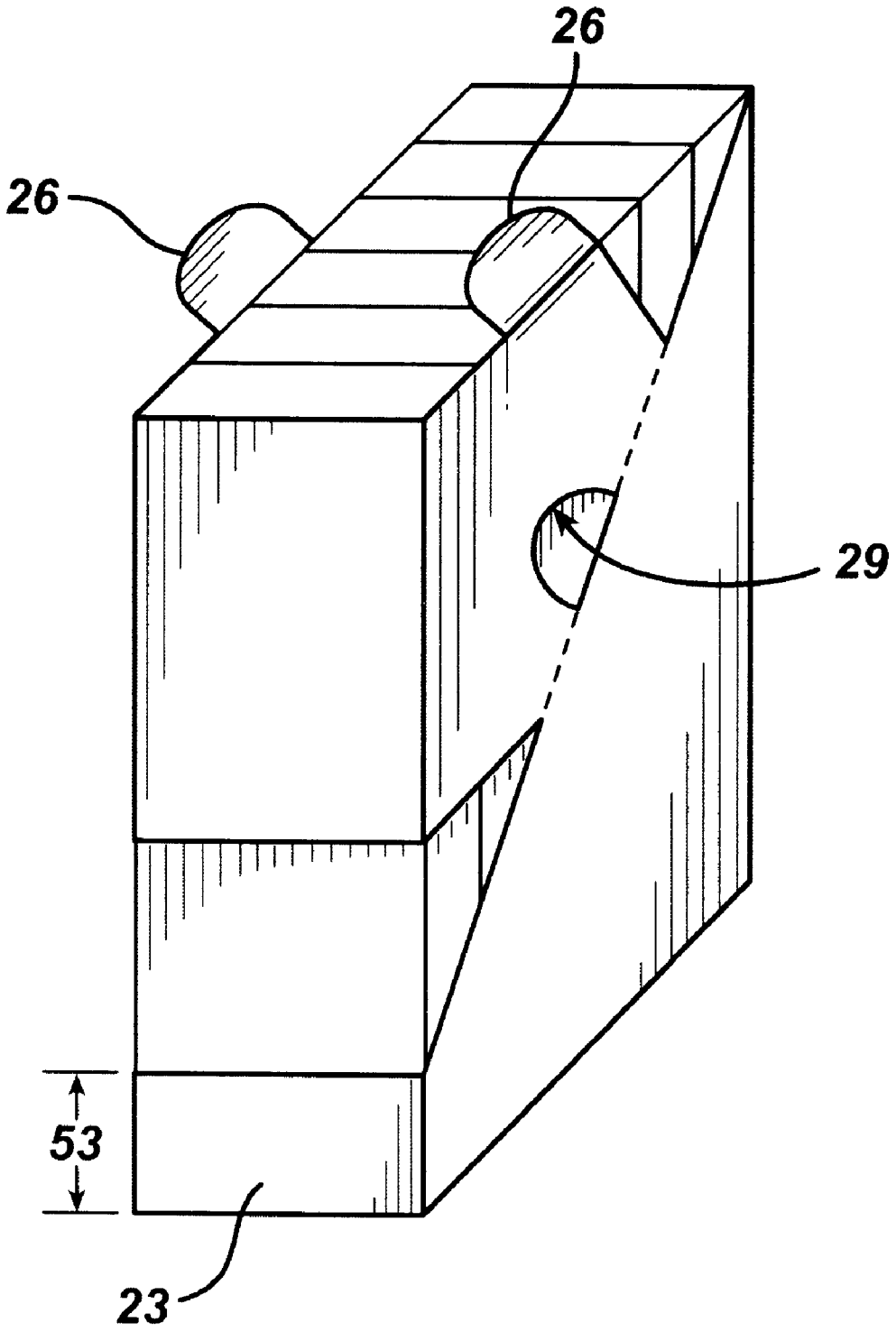
FIG. 2 is a perspective view of an inner container according to the present invention with both container top and bottom sections depicted, showing the optional tabs and the discontinuous line of weakness with an adjacent cutout.

For ease of removal of the inner container from a shipping container, one embodiment of the present invention provides at least one tab projecting from the top of an upper portion of a side wall, as illustrated in FIGS. 2 and 3. The tabs are designed to enable grasping by fingers and lifting of the inner container from the shipping container. Placement of the tabs is not critical, however, the tabs are preferably staggered, such that one is closer to the front wall of the inner container and the other is closer to the back wall of the inner container. This arrangement eases removal of the inner container from the shipping container and helps to balance the weight distribution of the products in the inner container while lifting the inner container out of the shipping container and moving the inner container.

The inner container may optionally contain a top wall, which is preferably a tuck wall. As used herein, a tuck wall is a wall having a free end with a tab formed at such free end. The tab of the free end is tucked in between neighboring walls of the inner container.

The bottom wall of the inner container may be a tuck wall or a self locking wall. As used herein, the self locking wall is a wall made from extensions of the front wall, two side walls, and back wall that fold over each other and lock into place.

Referring to FIGS. 1, 2 and 3, the inner container 10 has a front wall 1, side walls 2 and 3, and a back wall 4. A bottom wall 5 completes the container, for totally retaining and protecting articles contained therein. The back wall 4 has a top 6. Each of the front wall 1, and two side walls 2 and 3 contains an upper portion 20, 21, and 22 respectively, and lower portions 23, 24, and 25 respectively. The back wall 4 optionally contains an upper portion 29. The upper portions 20, 21, 22, and optionally 29 collectively form a container top section 90. The upper portions of the side walls 21 and 22 optionally contain tabs 26. The lower portions 23, 24, and 25, the back wall 4 and the bottom wall 5 collectively form a container bottom section 91. Corners 7 are formed where the upper portions of the walls, i.e. the upper front wall 20, side walls 21 and 22, and back wall 9 and/or the lower portions of the front wall 23, side walls 24 and 25, and the back wall 4 intersect. The upper portion of the front wall 20 may be connected to the lower portion of the front wall 23 by a portion of the discontinuous line of weakness 28. The lower portion of the front wall of the inner container has a height 53.

The container top section 90 and the container bottom section 91 are linked by the line of weakness 30. As shown in FIG. 2, the line of weakness 30 may optionally include an adjacent cutout 29.

Figure 4:
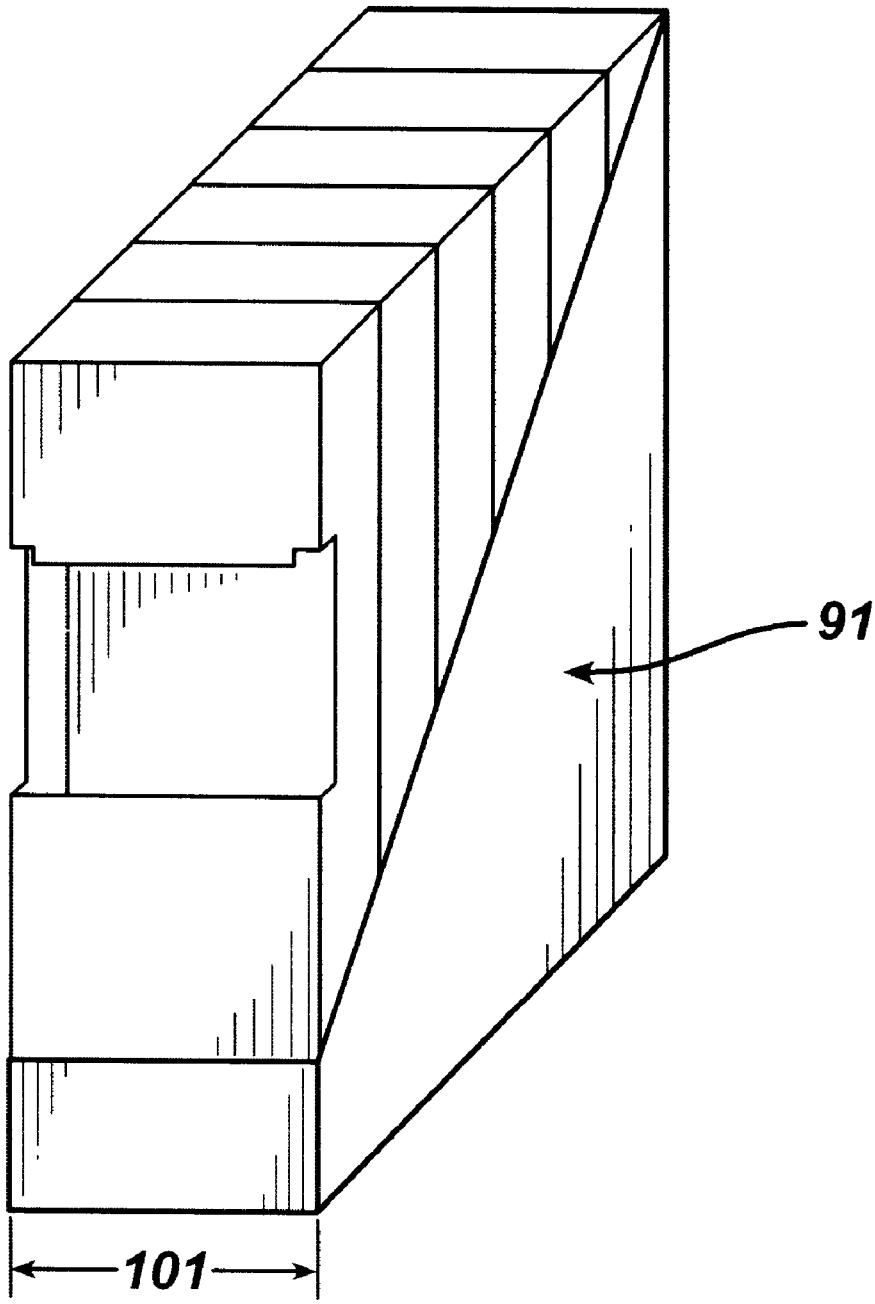
FIG. 4 is a perspective view of the display unit provided by tearing away the upper portions of the walls of an inner container according to the present invention.

The line of weakness 30 allows one to remove the container top section 90, while retaining the container bottom section 91 as a display unit for displaying contained products, as shown in FIG. 4.

The design of the line of weakness 30 will depend on the weight of the products held in the inner container. Generally, the line of weakness 30 has substantially constant resistance to separation along the lengths of its portions. For example, if the line of weakness 30 were a scored line, then it would be of constant depth and density in each portion. Alternatively, if the line of weakness 30 were a perforated line, the dimensions of the perforation components and the land components residing between adjacent perforation components would be constant. This can be seen more readily in FIG. 5.

Figure 5:
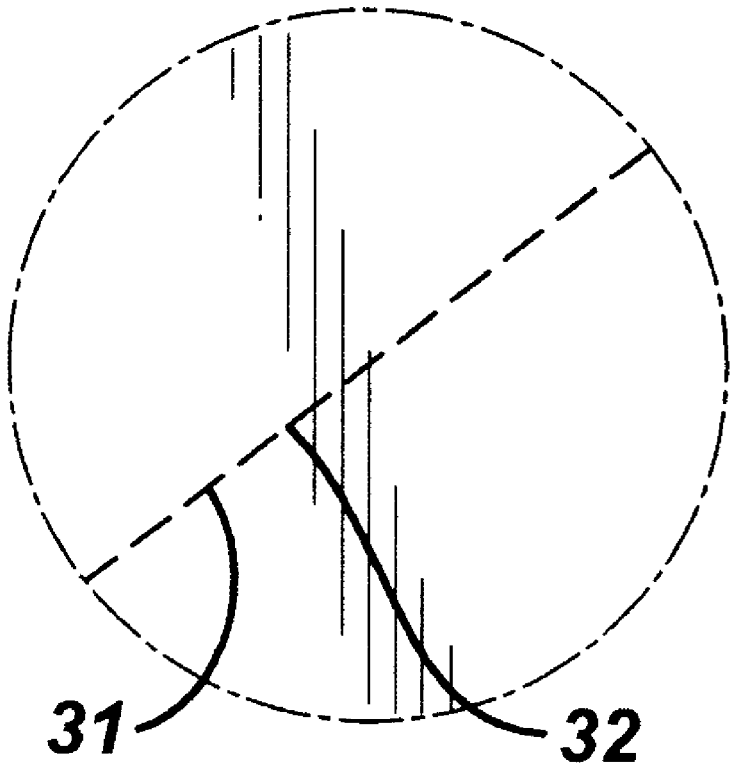
FIG. 5 is an enlarged view of a portion of the discontinuous line of weakness in FIG. 1.

FIG. 5 is an enlarged view of area 100 of FIG. 1, illustrating a preferred embodiment of the line of weakness 30 comprising perforation components 31 and land components 32. The dimensions of the perforation components 31 and land components 32 are preferably adjusted to ensure adequate strength for the inner container while transporting the products and protection of the products prior to removing the container top section 90, while allowing easy and clean opening of the container. The perforation components 31 are preferably from about 0.5 to about 25 millimeters in length, more preferably from about 2 to about 10 millimeters in length. The land components 32 are preferably from about 0.25 to about 4 millimeters in length, more preferably from about 0.5 millimeters to about 2.0 millimeters in length.

The substantially diagonal position of the line of weakness 30 on the side walls 2 and 3 is designed to provide proper retention of contained products and an unobstructed view of, and access to, products housed by the container. As seen in FIGS. 1, 2 and 3, the line of weakness 30 runs substantially diagonally along the side walls 2 and 3 such that when the container top section 90, including the upper portions of the side walls 21 and 22, the upper portion of the front wall 20, and optionally the upper portion 9 of the back wall is torn away and removed, the container bottom section 91 forms a display unit having side walls which increase in height from the front wall of the display unit to the back wall 4 of the display unit.

The height 53 of the lower portion of the front wall 23 of the inner container should be sufficient to provide retention of the products in the container, including during removal of the container top section 90, so as not to allow severe distortion of the products inside. For example, the height 53 may range from about 5 percent to about 30 percent, preferably from about 10 percent to about 20 percent of the total height of the front wall of the inner container, as measured from the bottom of the lower portion of the front wall to the top of the upper portion of the front wall.

FIG. 6 is a perspective view of an alternative embodiment of the inner container of the invention, wherein the back wall 4 of the inner container has an upper portion 9 and a lower portion 90. The inner container also has a top wall 60, which in this example is a tuck wall.

The height 100 of the upper portion 9 of the back wall 4 of the inner container should be sufficient to retain the contents of the inner container. For example, the height 100 may range from about 5 percent to about 10 percent, and preferably from about 10 percent to about 40 percent, based upon the total height of the backwall 4 of the inner container, as measured from the top of the upper portion 9 of the back wall 4 to the bottom of the lower portion 90 of the back wall.

Figure 7:
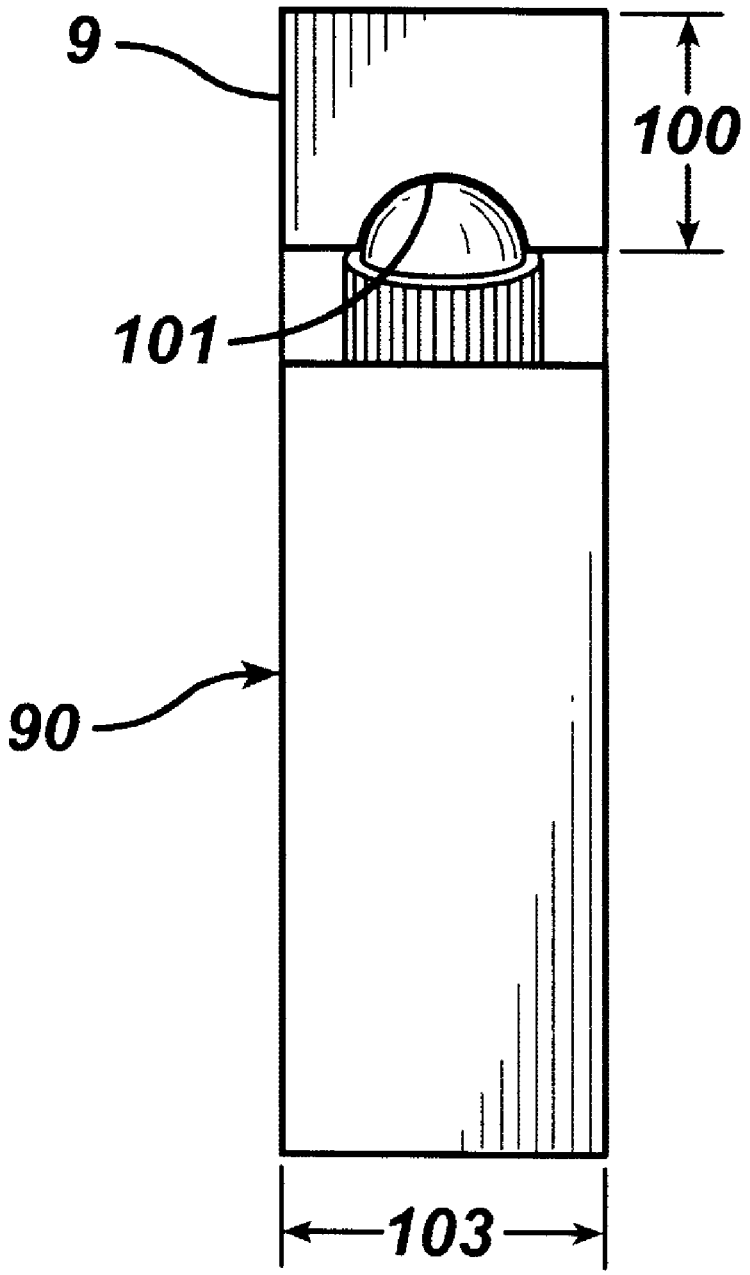
FIG. 7 is a rear view of the inner container of FIG. 6.

As shown in FIG. 7, the upper portion 9 may not be connected to the lower portion 90 along the back wall 4. In this embodiment, the lower portion 90 has a height of from about 30 percent to about 95 percent, and preferably from about 40 percent to about 80 percent as measured from the bottom of the lower portion 90 of the back wall 4 to the top of the upper portion 9 of the back wall 4.

The distance between the lower portion 90 of the back wall 4 and the upper portion 9 of the back wall 4 may range from about 5 percent to about 30 percent, and preferably from about 5 percent to about 20 percent, based upon the total height of the back wall.

As shown in FIG. 7, the back wall 4 may optionally include an adjacent cut out 101 the length and height of which is not critical. The shape of the cut out may be of any shape as aforedescribed. In general, the width of an adjacent cutout may range from about 10 percent to about 70 percent, and preferably from about 20 percent to about 60 percent, based upon the total width of the back wall. The height of an adjacent cutout may range from about 0.25 percent to about 60 percent, and preferably from about 0.50 percent to about 30 percent, based upon the total height of the upper portion 9 of the back wall. Although not shown, the front wall I may also contain a cutout having a similar size and shape to those suitable for use in the back wall 4.

In an alternative embodiment (not shown), the upper portion 9 of the back wail 4 and the lower portion 90 of the back wall 4 may be linked by a further portion of the discontinuous line of weakness. The length of this further portion of the discontinuous line of weakness may vary dependent upon, for example, the contents contained therein, but shall preferably have a perforation component as aforedescribed.

The length of the portion of the discontinuous line of weakness, whether positioned on the front wall 1 or the back wall 4, typically ranges from, based upon either the width of the front wall 101 or back wall 103, respectively, about 20 percent to about 80 percent, and preferably from about 40 percent to about 60 percent. Preferably the portion of the discontinuous line of weakness is centered about a longitudinal axis through either the front wall 1 or the back wall 4, respectively.

The inner container of the present invention can be made from any suitable material including, but not limited to paperboard, such as, but not limited to solid bleached sulfate board. The thickness of the paperboard may range from 0.30 millimeters to 0.80 millimeters, preferably from 0.35 millimeters to 0.50 millimeters. The paperboard is selected so as to provide protection during shipping and storing, and clean and easy opening. The paperboard selected can vary according to the weight of products inside the inner container.

EXAMPLE

The following is an example of an inner container within the scope of the present invention. The container was constructed with 0.45 millimeter solid bleached sulfate board. The bottom wall of the container was an auto lock bottom. The discontinuous line of weakness was a perforated line having land components 1 millimeter in length and perforation components 5 millimeters in length in each portion thereof.

An individual was recruited to open the inner container constructed above. The inner container performed well. The upper portions of the walls were easily removed, the display unit had a good appearance after opening, and the inner container provided adequate container strength.

The inner container of the present invention is useful for shipping, storing, and displaying a wide range of products, including but not limited to consumer products, such as disposable absorbent articles, hair care products, skin care products, and baby products; and pharmaceutical products, such as over the counter analgesics and cough/cold/influenza remedies. Products contained in the inner container of the present invention may be individually packaged, or packaged in groups of at least 2 articles. The individual packaging may be in the form of bottles, cans, pouches, sachets, bags, boxes, and the like. The inner container of the present invention may contain a single row of products or multiple rows of products.

The inner container of the present invention may optionally contain graphics on its outwardly disposed surfaces, illustrating preferred opening instructions. The optionally employed graphics may also relate to the contained products, including information additional to that on the products or packaging inside. The graphics may indicate how the contained products relate to a system in which multiple products can be combined for use according to various uses and needs.

The inner container can be placed onto a shelf or onto other various display configurations, such as in aisle or end of aisle stands.

The disclosures of all patents, as well as any corresponding published foreign patent applications, mentioned throughout this patent application are hereby incorporated by reference herein.

What is claimed is:

1. An inner container configured for shipping, storing, and/or displaying goods, including a bottom wall, two side walls, a front wall, and a back wall; the inner container further comprising a top section and a bottom section;

the top section comprised of an upper portion of the front wall, two upper portions of the side walls, and optionally an upper back wall;

the bottom section comprised of a lower portion of the front wall, two lower portions of the side walls, the back wall and the bottom wall, the container top and bottom sections being linked by a discontinuous line of weakness having portions positioned substantially diagonally on the two side walls; wherein removal of the container top section from the container bottom section provides a display unit having side walls that increase in height from the front wall of the display unit to the back wall of the display unit, and wherein, prior to removal of the container top section from the container bottom section, the upper portion of the front wall is not in contact with the lower portion of the front wall.

2. The inner container of claim 1, wherein the distance between the lower portion of the front wall and the upper portion of the front wall ranges from 5 percent to 80 percent of the total height of the front wall as measured from the bottom of the lower portion of the front wall to the top of the upper portion of the front wall.

3. The inner container of claim 2, wherein the upper portions of the side walls comprise at least one tab projecting therefrom.

4. The inner container of claim 1, housing a plurality of products.

5. The inner container of claim 4, wherein the products are individual packages of products.

6. The inner container of claim 5, wherein the products comprise skin care products.

7. The inner container of claim 1, wherein the upper portion of the back wall is not connected to the lower portion of the back wall.

8. The inner container of claim 1, wherein the upper portion of the back wall is connected to the lower portion of the back wall by a further portion of the discontinuous line of weakness.

9. The inner container of claim 1, wherein the distance between the lower portion of the back wall and the upper portion of the back wall ranges from about 5 percent to about 30 percent of the total height of the back wall as measured from the bottom of the lower portion of the back wall to the top of the upper portion of the back wall.

10. The inner container of claim 1 having at least about 1 cutout disposed along a portion between the container top section and the container bottom section.

11. The inner container of claim 10, wherein the cutout is located in at least one of the following locations selected from the front wall, the back wall, and the side wall.

12. The inner container of claim 1 wherein the side wall has a lower end and an upper end, and the length of the line of weakness along a side wall is from about 35 percent to about 90 percent, based upon the overall length of the side wall from the lower end to the upper end.

13. The inner container of claim 1 wherein the length of the discontinuous line of weakness along the front wall or back wall is from about 20 percent to about 80 percent, based upon the width of the front wall or back wall, respectively.

14. The inner container of claim 1, wherein the line of weakness is a perforated line comprising land components and perforation components.

15. The inner container of claim 14, wherein each land component is from about 0.25 to about 4 millimeters in length.

16. The inner container of claim 14, wherein each perforation component is from about 0.5 to about 25 millimeters in length.

17. The inner container of claim 1, wherein the upper portions of the side walls comprise at least one tab projecting therefrom.

* * * * *